United States Patent [19]

Barozzi et al.

[11] 4,334,791

[45] Jun. 15, 1982

[54] DEVICE FOR CONTROLLING THE TYPING ACTION OF A SINGLE TYPE CARRYING ELEMENT FOR TYPEWRITERS

[75] Inventors: Gian P. Barozzi; Giancarlo Horeschi, both of Tokyo, Japan

[73] Assignee: Xelavis S.A., Panama City, Panama

[21] Appl. No.: 168,275

[22] Filed: Jul. 10, 1980

[30] Foreign Application Priority Data

Jul. 11, 1979 [IT] Italy ..... 24282 A/79

[51] Int. Cl.[3] ..... B41J 1/60; B41J 7/92

[52] U.S. Cl. ..... 400/166; 400/157.3

[58] Field of Search ..... 400/157.3, 166; 101/93.03

[56] References Cited

U.S. PATENT DOCUMENTS 3,239,049 3/1966 Voit ..... 400/157.3 X
3,888,339 6/1975 Nowak et al. ..... 400/157.3 X
3,980,169 9/1976 Decker et al. ..... 400/157.3 X

FOREIGN PATENT DOCUMENTS 2336945 2/1974 Fed. Rep. of Germany ..... 400/166
2516234 11/1975 Fed. Rep. of Germany ..... 400/166

*Primary Examiner*—Paul T. Sewell
*Attorney, Agent, or Firm*—Karl F. Ross

[57] ABSTRACT

A device for controlling a type-carrying element in a single unit for typewriters or like machines comprises a stepped cam to execute the hammering action of the type-carrying element with an intensity independent from external factors and manually adjustable for all the characters of the type carrying element, and also, in addition, automatically for some characters of the type-carrying element, particularly for those having a smaller printing area, the stepped cam being provided to effect the hammering action by inertia following the action of a spring suitable to transmit a given initial thrust.

7 Claims, 2 Drawing Figures

Fig. 1
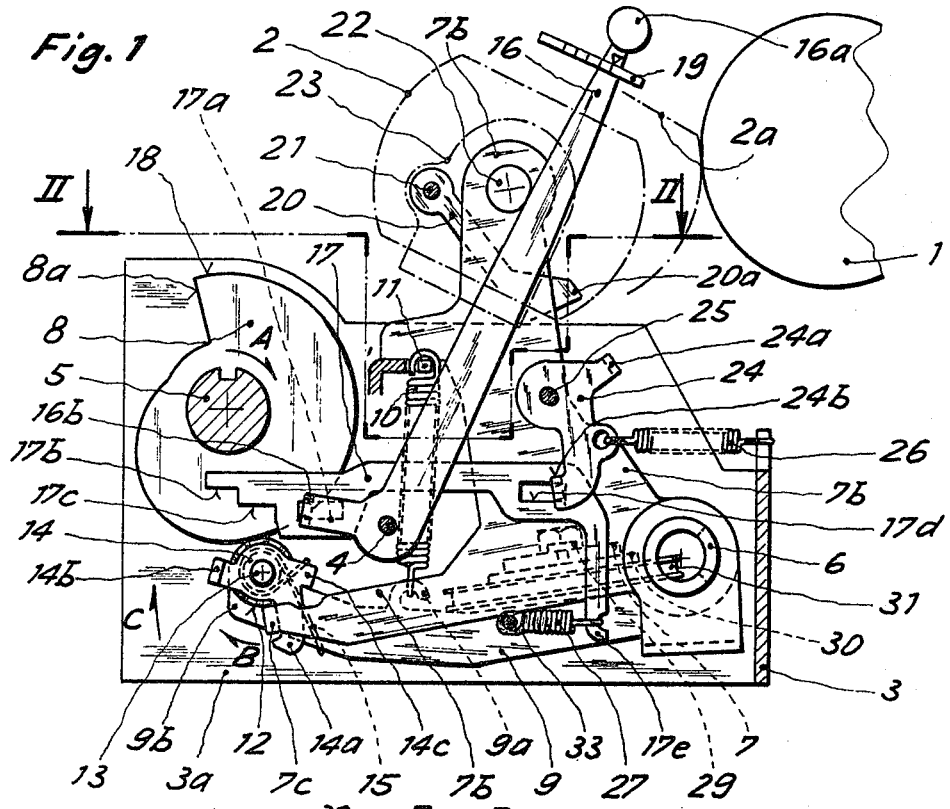
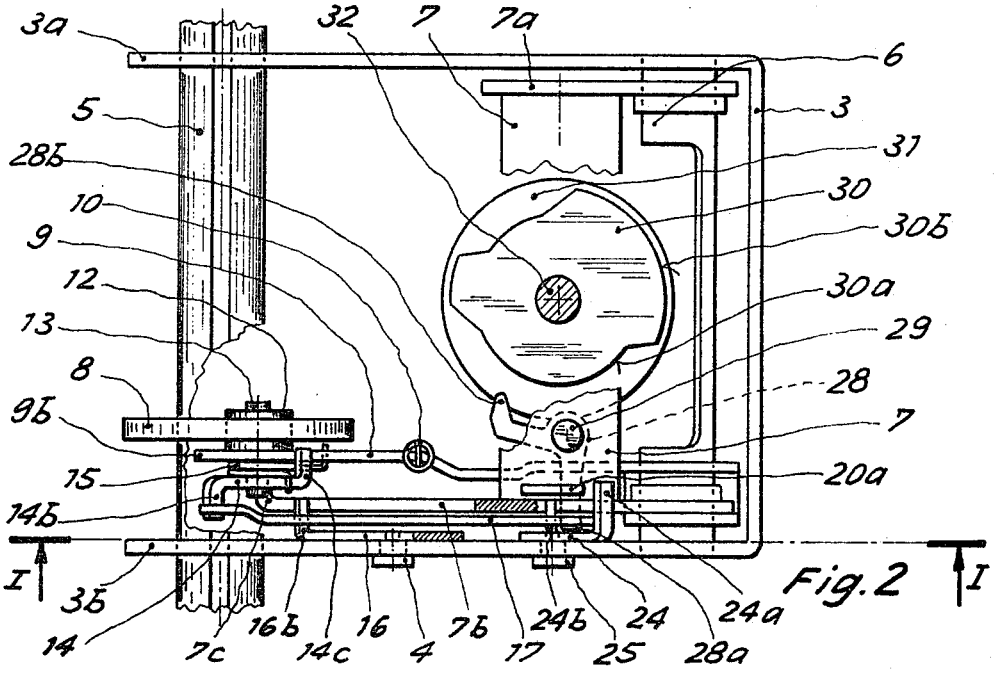
Fig. 2

DEVICE FOR CONTROLLING THE TYPING ACTION OF A SINGLE TYPE CARRYING ELEMENT FOR TYPEWRITERS

FIELD OF THE INVENTION

The present invention relates to a device imparting the typing movement to a type-carrying element of essentially spherical shape or the like, with adjustable intensity of the stroke, independent of external factors and with automatic variation related to the size of the printing area of the various type faces.

BACKGROUND OF THE INVENTION

As is known, in mechanisms for imparting the typing action, the stroke of the type-carrying element against the paper is effected in a controlled way either positively through a cam driven by a transmission shaft, or by means of an elastic member, but always through a movement controlled by the motor.

In both the known cases, the intensity of the stroke depends on the rotation speed of the driving shaft of the motor so that, for instance, it can vary because of a sudden voltage rise, or because of friction in the associated mechanism causing a visible difference in the intensity of the print of the character on the paper, with serious consequences for the appearance of the typewritten product.

Furthermore in the known machines a mechanism is provided for the correction of the printing of the very small signs or characters, e.g. commas, dots, and so on, by reducing the intensity of the hammering.

Such mechanism picks up the signal from the key and transmits it, by means of rods or flexible-transmission or similar devices to the hammering device by an expensive connection train. There are difficulties with transmission of the signal and in discriminating the signal for the small letters from that of the capitals because the signal coming from the key is the same in both cases.

OBJECT OF THE INVENTION

The object of this invention is to eliminate the thereinabove cited disadvantages, by providing a control device in which provision is made for the hammering movement to occur freely and by inertia following a more or less prolonged thrust initially imparted to the parts cooperating in the typing action by an elastic means whose action is stopped after a given path, which can be manually varied while variation of thrust path is automatically reduced when characters with smaller printing area must be struck, deriving the signal for such reduction from the positioning devices of the type-carrying element.

SUMMARY OF THE INVENTION

This object is attained by the use of a stepped cam against which a strike control lever is in contact, a spring, which keeps this lever constantly pressed against said cam and cooperating with the part provided for the hammering action. This lever is however released from the aforementioned parts at distances different from the final position so that these parts continue their motion to impart to the type carrying-element the kinetic energy necessary to strike with due intensity.

The release of the hammering means at different distances in relation with the elastic action, can be adjusted by hand operation from the outside, to set a certain intensity of stroke for the type writing, for example with respect to the number of copies which are printed simultaneously, or with respect to the thickness of the paper or with reference to the kind of ribbon, and also automatically in relation to the size of the printing area of the character, the stroke intensity being less for the smaller characters, such as the dot or the comma, even if the same characters are coupled with others on the same key.

The automatic variation of the stroke intensity is obtained by means of a cam mounted coaxially with the shaft driving the rotation of the sphere along the meridians, this cam being in contact with means for releasing the strike control lever from the lever transmitting the stroke to the type-carrying element after thrust paths of different lengths.

According to the invention the device for the control of the typing action of a type-carrying element in a single unit for typewriters, teletypes or the like comprises means for executing the hammering action of the type-carrying element with an intensity independent from external factors and manually adjustable for all the characters of the type carrying element, and also, in addition, adjustable automatically for some characters of the same element, particularly for those having a smaller printing area, these means being provided to effect the hammering action by inertia, following the action of means suitable to transmit a given initial thrust given by an elastic means, and obtaining the final variation of striking velocity by disengagement of the thrust means from said typing means after having run paths of length which can be varied by manual presetting for all the types of the type carrying element, and by automatic operation for particular type faces, with respect to the size of their printing areas.

BRIEF DESCRIPTION OF THE DRAWING

Further features and advantages of the invention will become more readily understood from the following detailed description of a preferred but not limitative embodiment of a typing control device for typewriters, teletypes or the like, with reference to the illustrative accompanying drawing in which:

FIG. 1 is a side view of the device for the typing action along the section line I—I of FIG. 2; and FIG. 2 is a plan view partly broken away along the line II—II of FIG. 1.

SPECIFIC DESCRIPTION

FIG. 1 shows a stroke control device for a type-carrying element or ball 2, positioned in front of a platen 1 of a typewriter, teletype or like machine. The single type carrying element 2 can have any known shape, for example a spherical, cylindrical, or like shape, and in the example shown is a spherical element which will be referred to as ball for simplicity.

On the ball 2 the characters or type faces are normally divided into two sets, a set of small (lower case) characters, and a set of capitals, or upper case characters, and include also conventional symbols and signs.

The stroke-control unit for the type-carrying element consists of a carriage generally indicated at 3, sliding axially on rails, not shown, parallel to the axis of the platen 1.

The carriage comprises two lateral plates 3*a* and 3*b* crossed by a main shaft 5 driving the other parts as will be specified below.

Both plates 3*a* and 3*b* (FIG. 2) carry a hollow shaft 6 on which the support 7 swivels by means of the arms 7*a*–7*b*.

The driving shaft 5 allows the axial sliding of the carriage 3 at each stroke, along an axis parallel to the platen 1, and is connected to a cam 8 for the hammering movement of the ball 2 against the platen 1.

Hinged on the same shaft 6 there is a lever 9 which, through the hook 9*a* is forced to rotate upwards (clockwise in FIG. 1) by a spring 10 anchored at a fixed point 11. This lever has an arm 9*b* whose cam-follower roller 12 is in constant contact with a cam 8 fixed on the driving shaft 5, and rotating in the direction of the arrow A (FIG. 1) and having a stepped profile 8*a*.

The lever 9 carries on the extension 9*b* a pin 13 protruding axially on both sides of the extension 9*b*.

The pin 13 is the hinge point (FIG. 2) for a balance lever 14 which has three arms 14*a*, 14*b*, 14*c*, the latter being engaged by a spring 15 whose other end is fixed to the arm 9*b* of lever 9.

Because of the action of this spring 15 the balance lever 14 tends to rotate in the direction of arrow B, around the pin 13.

Another arm 14*a* of the balance lever 14 serve as a hook.

Fixed to the support 7 is an arm 7*b*, which extends generally parallel to the lever 9 and is fitted at its free end with a tongue 7*c* bent toward the arm 14*a* of the balance lever 14.

The cam 8 fixed to the rotating main shaft 5 offers a path that, starting from a minimum distance from the center, rises gradually up to the point 8*a* at which the path drops suddenly in the radial sense to reach the lowest position; the shape of the profile from the beginning to the end is not crucial and can be any, as will be apparent from the following description.

On the plate 3*b* of the carriage 3 a lever 16 is hinged on a fixed pin 4 and projects outside the writing device by means of a handle 16*a*. The other side of the lever is formed with a bent tongue 16*b* on which by means of an eye 17*a* a sliding rod 17 slides. The rod 17 lies above the arm 14*b* of the balance lever 14 and can be interposed in the path of said arm 14*b* when the lever 9 swings on the shaft 6.

The operation is as follows: in the rest position before beginning the working cycle of the machine, the small roller 12 of lever 9 rests against the profile 18 of cam 8 under the action of the spring 10 in the position of maximum distance from the center, as shown in FIG. 1; when the machine is started, and the driving shaft 5 begins its rotation in the direction of the arrow A, the roller 12 overruns the top point 8*a* of the profile 18 of the cam 8 and falls inwardly until it reaches the profile of minimum distance from the center.

In this movement, the spring 10 that had been stretched by the action of the roller 12 on the profile 18, is free to contract and it pulls the whole unit freely because the roller 12 has temporarily lost contact with said profile 18 of the cam 8.

The balance lever 14 under the action of the spring 15, was with its arm 14*a* under the tongue 7*c* so that by means of this, it moves the arm 7*b* and with it the support 7, in rotation following arrow C, that is, around the shaft 6, carrying the ball 2 in the direction of the platen 1.

During the so-called free fall movement of the small roller 12 from the path 18 of the aforementioned cam, the other arm 14*b* of the lever 14 strikes at a point in its movement, the extension 17*b* of the slider 17; the arm 14*b* rotates balance lever 14 and disengages from the tongue 7*c* to free the latter.

In this way the arm 7*b* fixed to the support 7 is free to move, no longer under the direct action of the spring 10, but by the kinetic energy (momentum) gained by effect of the velocity imparted by the same spring during the first portion of path.

The unit consisting of the ball 2 with the support and the means connected to it continues its motion until it reaches the position 2*a* shown in FIG. 1, that is against the platen 1 to print the chosen type.

This position 2*a* is reached, as was said, by effect of the residual kinetic energy, gained in the first portion of forced movement caused by the spring 10. Such residual energy can be varied by varying the length of the path along which the spring 10 pulls positively the whole unit in motion.

This path can be shortened operating the handle 16 in the direction suitable to shift the tongue 16*b*, of the mentioned lever 16 in a lower position thereby lowering, through the engagement of said tongue in the window 17*a* of the slider 17, the extension 17*b* of the slider itself, so that the arm 14*b* of the balance lever 14 will meet the said extension 17*b* after a path shorter than that with the extension 17*b* set in a higher position.

A suitable graduation 19 can be provided for at a fixed point, so that it be possible to determine, relative to a pointer fixed to the lever 16*a*, the desired position to have a given intensity of the hammering action wanted in the printing of the type.

To reduce further the intensity of the stroke for the symbols or the characters with a very small area, the slider 17 moves toward the left in FIG. 1 until the step 17*c* is placed in the trajectory of the arm 14*b* of the balance lever 14, reducing further the path in which the spring 10 pulls positively the whole unit in motion. In order to position the type faces of the ball 2 with the platen a tie-rod 20 is provided, which with its pin 21 rotates the support 23 of the ball. The support 23 is pivoted at 22 on the arms 7*a* and 7*b* of the support 7, and under the control of the respective keys, rotates said sphere upwards or downwards.

In the present invention it is provided that the types having a small printing area, be concentrated in the lower half of the ball 2 so that, when the respective keys are pressed, the tie-rod 20 rotates the ball 2 counterclockwise, (see FIG. 1) moving downwards.

On the tie-rod 20*a* hook 20*a* is provided which in such movement comes in contact with the finger 24*a* of a lever 24 hinged on a pivot 25 fixed to the plate 3*b*, and which in the rest position (FIG. 1) rests on the bottom of the window 17*d* of the slider 17 which on its turn rests with the extremity of its window 17*a* on the tongue 16*b* of the lever 16.

Continuing its path downward, the hook 20*a* rotates the lever 24 clockwise against the action of the spring 26 fixed to the frame 3, allowing the slider 17 to move to the left, under the action of its own spring 27 hooked on its extension 17*e* and to a pin 33 fixed to the plate 3*b*, to bring the step 17*c* unto the trajectory of the arm 14*b* of the balance lever 14.

The slider 17 during its movement to the left meets with its extension 17*e* the extremity 28*a* of the lever 28 hinged on the pivot 29 fixed to the frame 7 and rotates it clockwise.

During such rotation the extension 28*b* of the lever 28 comes in contact with the profile of a cam 30 fixed to the wheel 31 which is rotated by the devices for the positioning of the ball along the vertical axis (not shown).

As shown in FIG. 2, the extension 28*b* of lever 28 under the action of the extension 17*e* of the lever 17 can contact the profile 30*a* of the cam 30 allowing, as explained, the slider to displace to the left.

In the case that the extension 28*b* should meet the profile of larger radius 30*b* of the cam 30 which rotates to select a capital letter on the ball, with no necessity, fherefore, of any reduction of intensity of the stroke, the extension 28*a* prevents the slider 17 from moving to the left, even if it is left free to move by the extension 24*b* of the lever 24, and as a consequence, the slider position would not be changed allowing the same intensity of stroke which was chosen by the setting of lever 16.

The mentioned cam 30 is divided into two parts; the lower part seen in FIG. 2 controls the intensity of the stroke of the small characters, while the upper part controls the intensity of stroke for the capitals.

It follows that when the cam 30 is turned through 180° to set the typing of the small or lower case characters.

It follows that by varying the profile of the cam 30, one can obtain the reduction of the intensity of typing of one or more types, independently of their radial positions on the sphere and also independently of the fact that they belong to the portion of sphere where there are the capitals or small types. From what has been described it follows that the intensity of typing depends only on the effect of the velocity that the spring 10 is able to impart to the whole moving mass, in the absence of obstacles.

Consequently, the intensity of typing is independent of any external factor which actuates the machines, for example, the line voltage or internal friction of the moving parts or similar.

Furthermore, according to the present invention, all the parts cooperating in the setting of the typing element and to its hammering action, are contained in the carriage 3, that is in a single unit separate and distinct from all the other parts of the machine, such unit being movable axially to typewrite, or else kept still while the platen moves or any other support moves.

This enables to achieve a remarkable simplification in the elements of the writing machine to which such carriage can be associated.

It is clear that many variations of construction may be applied to what has been described without departing from the spirit and the characteristics of the present invention.

What is claimed is:

1. In a printing machine having a platen, a printing element juxtaposed with said platen and formed with a multiplicity of type characters including large and small characters selectively juxtaposable with said platen for printing upon a paper interposed between said element and said platen, selector means operable by respective keys for selectively rotating said element to juxtapose each character with the platen, and a mechanism for impacting said element against said platen, the improvement wherein said mechanism comprises:

a support for said element pivotally mounted for swinging movement about an axis parallel to said platen;

a spring stressable to generate impact energy;

means for coupling said spring to said support for imparting inertial displacement to said suppport about said axis;

means for decoupling said spring from said support prior to full impact of said element against said platen whereby inertial displacement of said support free from action by said spring continues beyond the point at which said spring is decoupled from said support;

manual control means operatively connected to said decoupling means for varying said point to adjust the degree of impact; and automatic control means responsive to said selector means and operatively connected to said decoupling means for varying said point to modify said impact in accordance with the size of the character juxtaposed with said platen.

2. The improvement defined in claim 1 wherein said machine has a driving shaft which is rotated, said means for coupling said spring to said support including a lever pivotal about said axis, a cam having a step profile mounted on said shaft, a cam follower roller bearing against said profile of said cam and carried by said lever, said spring being connected to said lever and catch means on said lever engageable with and disengageable from said support.

3. The improvement defined in claim 2 wherein said catch means is swingable about a pivot on said lever and has a tongue, said supporting having an arm extending generally along said lever and engageable by said catch means, said tongue having a trajectory as said lever swings about said axis under the action of said spring, said decoupling means comprising a stepped slider positionable in said trajectory at various points to select the point at which said catch means disengages said arm from said lever and thereby frees said support for continued inertial movement.

4. The improvement defined in claim 3 wherein said manual control means comprises another lever operatively connected to said slider for varying the point along the trajectory at which said tongue engages said slider.

5. The improvement defined in claim 3 or claim 4 wherein said automatic control means includes a further cam operatively connected to said selector means, and a cam follower responsive to said further cam for adjusting the position of said slider and thereby controlling the point at which said tongue engages said slider to release said catch means.

6. The improvement defined in claim 3 or claim 4 wherein said automatic control means includes means responsive to the angular orientation of said element on said support for controlling the position of said slider to vary the point at which said tongue engages said slider to release said catch means.

7. The improvement defined in claim 3 or claim 4 wherein said support, said lever to said cam and said spring are provided on a carriage shiftable along said platen.

* * * * *